US008766869B2

(12) United States Patent
Kakuya et al.

(10) Patent No.: US 8,766,869 B2
(45) Date of Patent: Jul. 1, 2014

(54) ANTENNA APPARATUS

(75) Inventors: Yuuji Kakuya, Okazaki (JP); Akira Takaoka, Okazaki (JP); Hidenori Wada, Anjo (JP); Kouji Yamashita, Kariya (JP)

(73) Assignees: DENSO CORPORATION, Kariya (JP); Nippon Soken, Inc., Nishio (JP)

( * ) Notice: Subject to any disclaimer, the term of this patent is extended or adjusted under 35 U.S.C. 154(b) by 952 days.

(21) Appl. No.: 12/798,228

(22) Filed: Mar. 30, 2010

(65) Prior Publication Data

US 2010/0245192 A1 Sep. 30, 2010

(30) Foreign Application Priority Data

Mar. 31, 2009 (JP) ..... 2009-86703

(51) Int. Cl.
*H01Q 7/00* (2006.01)

(52) U.S. Cl.
USPC ..... 343/866; 343/726; 343/728

(58) Field of Classification Search
USPC ..... 343/726, 728, 866, 702, 846
See application file for complete search history.

(56) References Cited

U.S. PATENT DOCUMENTS

| | | | | |
|---|---|---|---|---|
| 7,439,922 | B2 * | 10/2008 | Autti | 343/702 |
| 7,639,194 | B2 * | 12/2009 | Chi et al. | 343/702 |
| 7,777,688 | B2 * | 8/2010 | Tani et al. | 343/852 |
| 8,207,899 | B2 * | 6/2012 | Ishimiya | 343/702 |

FOREIGN PATENT DOCUMENTS

| | | |
|---|---|---|
| EP | 1 154 513 | 11/2001 |

* cited by examiner

*Primary Examiner* — Jacob Y Choi
*Assistant Examiner* — Kyana R Robinson
(74) *Attorney, Agent, or Firm* — Harness, Dickey & Pierce, PLC

(57) ABSTRACT

An antenna apparatus includes: a ground substrate; and a loop antenna having first and second polarized wave surfaces, which are perpendicular to the substrate. The substrate provides an antenna, which is excited and vibrated together with the loop antenna. The antenna has a first polarized wave component in parallel to the first polarized wave surface and a second polarized wave component in parallel to the second polarized wave surface. A polarized wave ratio between the first polarized wave component and the second polarized wave component in the substrate is substantially equal to a polarized wave ratio between the first polarized wave surface and the second polarized wave surface in the loop antenna.

6 Claims, 3 Drawing Sheets

ANTENNA APPARATUS

CROSS REFERENCE TO RELATED APPLICATION

This application is based on Japanese Patent Application No. 2009-86703 filed on Mar. 31, 2009, the disclosure of which is incorporated herein by reference.

FIELD OF THE INVENTION

The present invention relates to an antenna apparatus.

BACKGROUND OF THE INVENTION

Recently, dimensions of wireless devices and mobile devices such as a mobile terminal are minimized. The mobile terminal is suitably used for a keyless entry system in a vehicle. Thus, it is required to reduce dimensions of an antenna mounted in the mobile terminal.

The above built-in antenna apparatus in the mobile terminal and the like is described in JP-A-2000-244219 (corresponding to EP-1154513). The antenna apparatus is built in a wireless communication terminal for communication, and includes a loop antenna device having a loop surface, which is perpendicular to a substrate.

Since the loop antenna device is perpendicular to the substrate, the loop surface is perpendicular to a body of a person when the person as a user uses the wireless communication terminal to communicate. Thus, a gain of the loop antenna device is improved.

Further, in the antenna apparatus, an antenna element having a loop shape for providing the loop antenna device is bent at a midpoint of the element by 90 degrees so that the antenna element can receive both polarized waves of a vertical polarized wave and a horizontal polarized wave.

In the antenna apparatus, a balance-unbalance conversion circuit is coupled with a power supply point of the loop antenna device. The balance-unbalance conversion circuit reduces current flowing into the substrate having a ground potential. Thus, the balance-unbalance conversion circuit prevents the substrate from functioning as an antenna. If the substrate functions as the antenna, when the body of the user approaches the antenna apparatus, the function of antenna in the apparatus is reduced by influence of the human body. Thus, in JP-A-2000-244219, the balance-unbalance conversion circuit reduces the current to the substrate, so that the substrate does not function as the antenna. Thus, the reduction of gain of the antenna apparatus caused by approach of the human body is restricted.

In the antenna apparatus, since the substrate does not function as the antenna, a polarized wave ratio between the vertical polarized wave and the horizontal polarized wave is secured. Specifically, the polarized wave ratio is substantially constant even when conductive object such as a human body approaches the antenna apparatus.

However, in the antenna apparatus, although the polarized wave ratio is constant without depending on existence of a conductive object, the constant polarized wave ratio is performed with using the balance-unbalance conversion circuit for reducing current to the substrate so as not to form the antenna with the substrate. Thus, it is necessary to use the balance-unbalance conversion circuit. Thus, a manufacturing cost of the antenna apparatus increases.

Further, only the loop antenna device provides to receive both of the vertical polarized wave and the horizontal polarized wave. Thus, it is difficult to obtain high gain with respect to a whole of the antenna apparatus.

SUMMARY OF THE INVENTION

In view of the above-described problem, it is an object of the present disclosure to provide an antenna apparatus with a high gain and a low manufacturing cost. The antenna apparatus provides a constant polarized wave ratio without depending on existence of a conductor, which approaches the antenna apparatus.

According to an aspect of the present disclosure, an antenna apparatus includes: a ground substrate; and a loop antenna having first and second polarized wave surfaces, which are perpendicular to the substrate. The substrate provides an antenna, which is excited and vibrated together with the loop antenna. The antenna has a first polarized wave component in parallel to the first polarized wave surface and a second polarized wave component in parallel to the second polarized wave surface. A polarized wave ratio between the first polarized wave component and the second polarized wave component in the substrate is substantially equal to a polarized wave ratio between the first polarized wave surface and the second polarized wave surface in the loop antenna.

In the antenna apparatus, when a conductive object does not approach the apparatus, a combination of the loop antenna and the antenna formed by the substrate provides high gain. Even when the conductive object approaches the apparatus, since emission from the substrate contributes to emission from a whole of the apparatus, the combination of the loop antenna and the antenna formed by the substrate provides high gain.

Further, the emission from the whole of the apparatus is a summation of electric field emission from the loop antenna and electric field emission from the antenna formed by the substrate. Thus, the polarized wave ratio of the whole of the apparatus is equal to the polarized wave ratio of the loop antenna or the polarized wave ratio of the substrate.

When the conductive object approaches the antenna apparatus, the substrate may reduce a function as the antenna. However, since the polarized wave ratio of the loop antenna is equal to the polarized wave ratio of the substrate, the polarized wave ratio of the whole of the apparatus is not changed even when the substrate reduces the function as the antenna, and only the electric field emission from the loop antenna is effective.

Thus, the polarized wave ratio of the whole of the apparatus is secured without depending on existence of the conductive object. Accordingly, the antenna apparatus has a high gain and a constant polarized wave ratio without depending on existence of the conductive object. Further, since the apparatus is formed easily, a manufacturing cost of the apparatus is low.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

Figure 1:
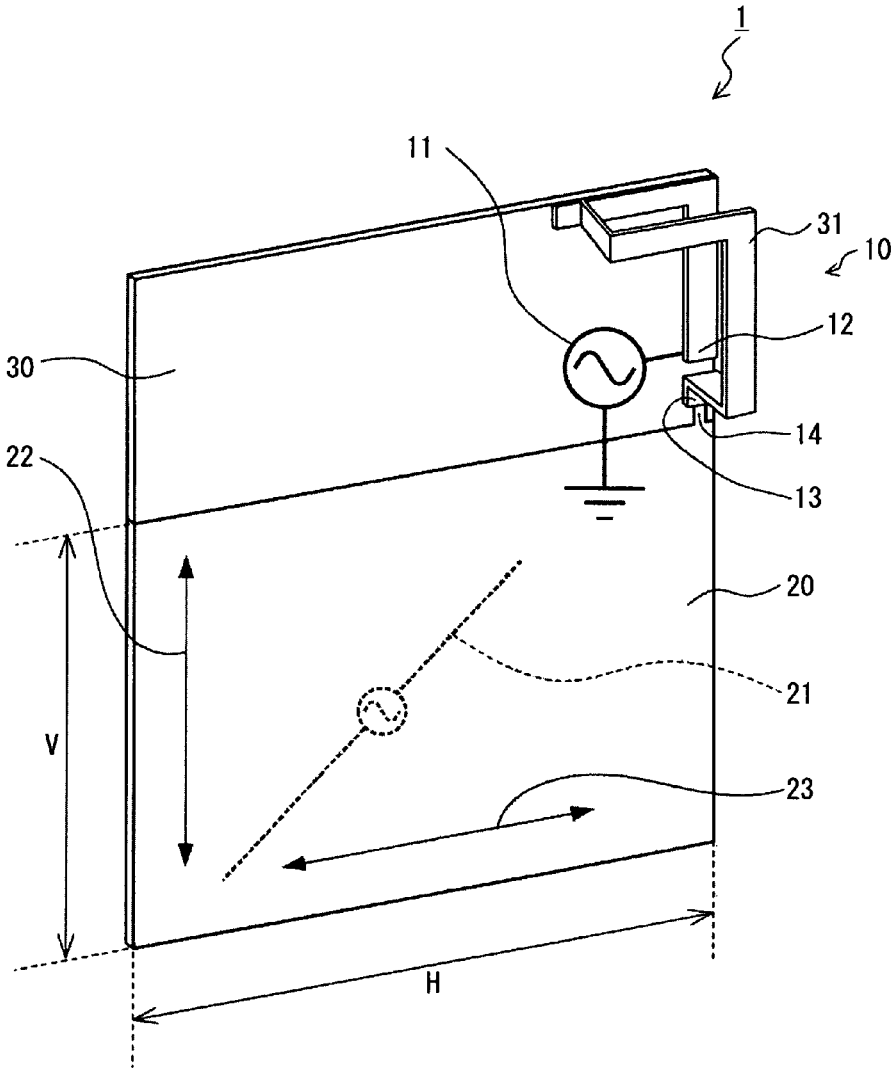
FIG. 1 is a diagram showing an antenna apparatus.
Figure 2:
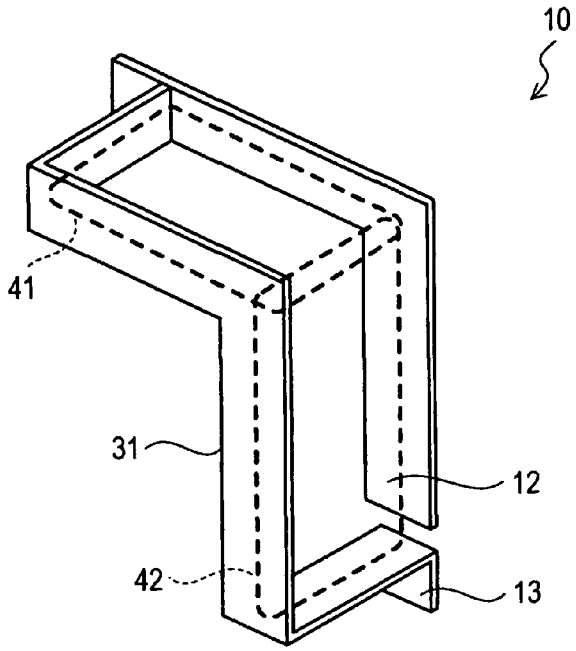
FIG. 2 is a diagram showing a loop antenna in the antenna apparatus.

FIG. 1 shows a whole of an antenna apparatus 1 according to an example embodiment. FIG. 2 shows a small loop antenna 10 in the apparatus 1.

The antenna apparatus 1 includes a circuit board 30 and a wireless circuit 11, which is disposed on the board 30. Further, the apparatus 1 includes the small loop antenna 10 and a ground substrate 20.

The circuit board 30 is made of, for example, resin, and a wiring pattern of the wireless circuit 11 is formed on the board 30. Further, various circuit devices are mounted on the board 30. The board 30 is accommodated in a casing (not shown) of a mobile device. The wireless circuit 11 transmits data to and receives data from an external communication device (not shown).

The small loop antenna 10 in the apparatus 1 includes an antenna element 31 having a loop shape. The antenna element 31 is bent at a middle point of the element 31 by 90 degrees so that the antenna element 31 has a L shape. The small loop antenna 10 has two polarized wave surfaces 41, 42 as shown in FIG. 2. One of the polarized wave surface is a horizontal polarized wave surface 41, and the other of the polarized wave surface is a vertical polarized wave surface 42. The horizontal polarized wave surface 41 is perpendicular to the vertical polarized wave surface 42. Thus, the antenna element 31 transmits and receives both of a horizontal polarized wave and a vertical polarize wave.

Each of the horizontal polarized wave surface 41 and the vertical polarized wave surface 42 in the small loop antenna 10 is perpendicular to the circuit board 30, i.e., a mounting surface of the board 30, on which various devices such as a circuit element is mounted. Thus, the small loop antenna 30 is formed on the board 30. One end of the antenna element 31 provides a power supply point 12, which is connected to the wireless circuit 11. The other end of the antenna element 31 provides a ground point 13, which is coupled with the ground substrate 20 via a wiring pattern 14 for grounding.

The small loop antenna 10 has a loop length of the antenna element 31. The loop length is shorter than a wavelength of an electric wave, which is received by and transmitted from the apparatus 1. For example, the loop length is a tithe of the wavelength. Alternatively, the loop length may be determined differently. Further, it is not necessary to use the small loop antenna 10. Alternatively, the apparatus 1 may include a conventional loop antenna.

The ground substrate 20 functions as a ground potential of the wireless circuit 11 since the wireless circuit 11 is coupled with the substrate 20. Further, the substrate 20 functions as an antenna. The substrate 20 has a side, which is parallel to the horizontal polarized wave surface 41 of the small loop antenna 10, and another side, which is parallel to the vertical polarized wave surface 42 of the small loop antenna 10. Specifically, the substrate has a square shape with four sides. The substrate 20 is coupled with a ground point 13 of the small loop antenna 10 via the wiring pattern 14 for the ground.

Thus, when the wireless circuit 11 energizes the small loop antenna 10 so that current flows through the small loop antenna 10, the small loop antenna 10 emits an electric field having a predetermined polarized wave ratio. A part of the current flowing through the small loop antenna 10 flows into the ground substrate 20 via the wiring pattern 14 from the ground point 13. Thus, the ground substrate 20 is also excited and vibrated so that the substrate 20 functions as an antenna. Thus, the substrate 20 also emits an electric field having a predetermined polarized wave ratio.

The current flowing through the substrate 20 mainly flows an edge of the substrate 20 when the substrate functions as an antenna. Specifically, the current includes a horizontal current component 23 parallel to the horizontal polarized wave surface of the small loop antenna 10 and a vertical current component 22 parallel to the vertical polarized wave surface of the small loop antenna 10.

Thus, the antenna provided by the substrate 20 is viewed as an equivalent dipole antenna 21 for exciting and vibrating current, which is synthesized from two current components 22, 23. Thus, the antenna apparatus 1 includes a combination of the small loop antenna 10 and the equivalent dipole antenna 21.

Here, the polarized wave ratio of the small loop antenna 10, which is a ratio between the vertical polarized wave and the horizontal polarized wave, depends on areas of the horizontal polarized wave surface 41 and the vertical polarized wave surface 42. Thus, a ratio of area between the horizontal polarized wave surface 41 and the vertical polarized wave surface 42 corresponds to the polarized wave ratio. Accordingly, when the small loop antenna 10 having a predetermined polarized wave ratio is formed, the ratio of area between the horizontal polarized wave surface 41 and the vertical polarized wave surface 42 is set to be equal to the predetermined polarized wave ratio.

The antenna provided by the substrate 20, i.e., the equivalent dipole antenna 21 has a polarized wave ratio between a polarized wave component in parallel to the horizontal polarized wave surface 41 and a polarized wave component in parallel to the vertical polarized wave surface 42. The polarized wave ratio of the equivalent dipole antenna 21 depends on a ratio between a horizontal current component 23 and a vertical current component 22 flowing through the substrate 20. Thus, the ratio between horizontal current component 23 and the vertical current component 22 corresponds to the polarized wave ratio of the equivalent dipole antenna 21.

The horizontal current component 23 and the vertical current component 22 flowing through the substrate 20 are arranged on the edge of the substrate 20, as shown in FIG. 1. Thus, the magnitude of each of the horizontal current component 23 and the vertical current component 22 depends on a dimension of the edge of the substrate 20. Specifically, the magnitude of the horizontal current component 23 depends on a dimension of the edge in the horizontal direction, i.e., a horizontal length H. The magnitude of the vertical current component 22 depends on a dimension of the edge in the vertical direction, i.e., a vertical length V. Accordingly, when a ratio between the horizontal length H and the vertical length V in the substrate 20 is set to be a predetermined value, the ratio between the horizontal current component 23 and the vertical current component 22 is set to be a predetermined ratio. Thus, the predetermined polarized wave ratio of the equivalent dipole antenna 21 is obtained.

Figure 3:
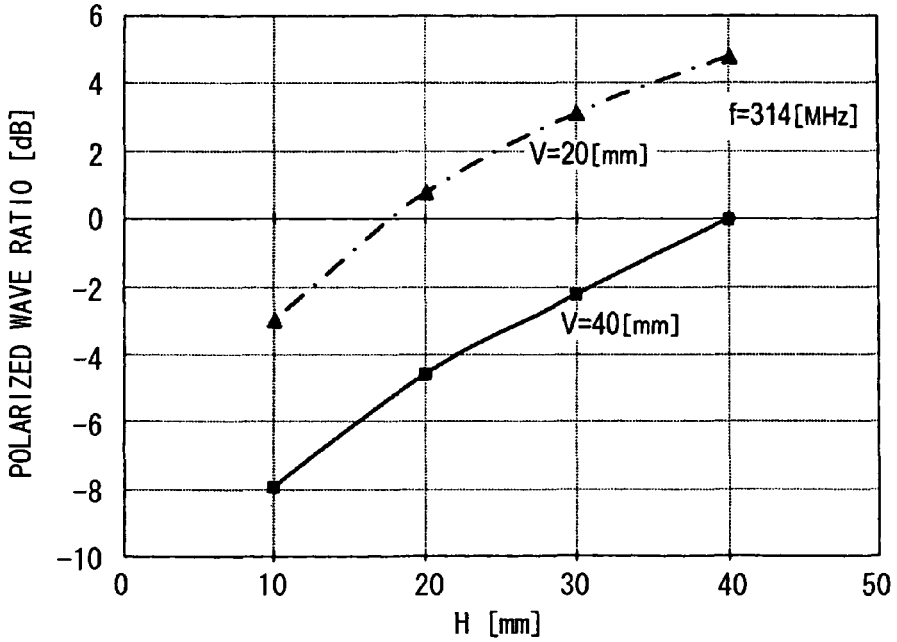
FIG. 3 is a graph showing a relationship between a polarized wave ratio and a horizontal dimension of a substrate.

FIG. 3 shows a relationship among the polarized wave ratio of the substrate 20, i.e., the equivalent dipole antenna 21, the horizontal length H and the vertical length V of the substrate 20. When the vertical length V of the substrate 20 is 40 millimeters or 20 millimeters, and the horizontal length H of the substrate 20 is varied, the polarized wave ratio of the substrate 20 is measured. Here, a frequency of measurement current is, for example, 314 MHz.

As shown in FIG. 3, the polarized wave ratio of the substrate 20, the horizontal length H and the vertical length V are correlated. In FIG. 3, the relationship among the polarized wave ratio of the substrate 20, the horizontal length H and the vertical length V of the substrate 20 has substantially linear correlation. Accordingly, based on the correlation, the dimensions of the substrate 20 are determined so that the substrate 20 provides the equivalent dipole antenna 21 having a predetermined polarized wave ratio.

Thus, by setting the ratio of areas between the horizontal polarized wave surface 41 and the vertical polarized wave surface 42, the small loop antenna 10 having the predetermined polarized wave ratio is obtained. Further, by setting the horizontal length H and the vertical length V of the substrate 20, the substrate 20 having the predetermined polarized wave ratio is obtained.

For example, when the predetermined polarized wave ratio of the substrate 20 is −3 dB, the horizontal length H is set to be 10 millimeters, and the vertical length V of the substrate 20 is set to be 20 millimeters. Alternatively, when the predetermined polarized wave ratio of the substrate 20 is 0 dB, the horizontal length H is set to be 40 millimeters, and the vertical length V of the substrate 20 is set to be 40 millimeters. These dimensions are merely an example.

In the substrate 20, the horizontal length H and the vertical length V of the substrate 20 are set so that the polarized wave ratio of the substrate 20 is equal to the polarized wave ratio of the small loop antenna 10. Thus, the polarized wave ratio of the small loop antenna 10, the polarized wave ratio of the substrate 20 and the polarized wave ratio of a whole of the antenna apparatus 1 are equalized. In this case, even when the conductor approaches the antenna apparatus 1, the polarized wave ratio of a whole of the antenna apparatus 1 maintains to be constant.

Figure 4A:
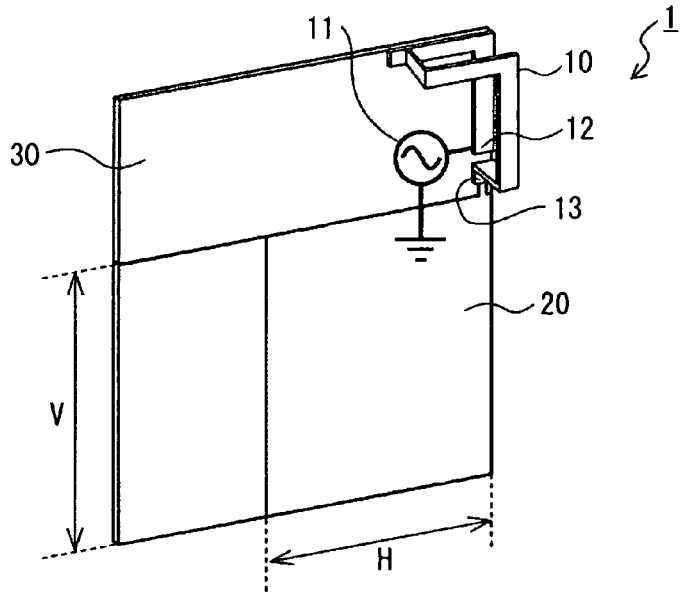
FIG. 4A is a diagram showing the antenna apparatus in a case where there is no conductor near the antenna apparatus.
Figure 4B:
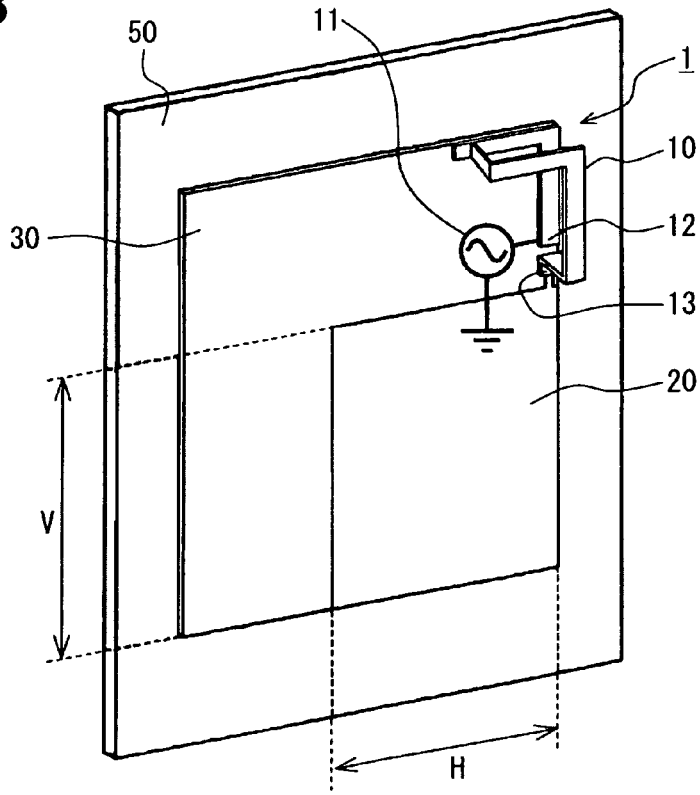
FIG. 4B is a diagram showing the antenna apparatus in a case where a conductor is disposed near the apparatus.

FIG. 4A shows a case where there is no conductor near the antenna apparatus 1, and FIG. 4B shows a case where there is the conductor 50 near the antenna apparatus 1.

The polarized wave ratio of a whole of the antenna apparatus 1 is determined by summing the electric field of the equivalent dipole antenna 21 formed by the substrate 20 and the electric filed of the small loop antenna 10. However, when the conductor 50 approaches the antenna apparatus 1, the electric field emitted from the substrate 20 is mainly cancelled with an image current on the conductor 50, so that the electric field is not emitted. Accordingly, when the conductor 50 approaches the antenna apparatus 1, only the polarized wave ratio of the small loop antenna 10 is detected at a place far from the antenna apparatus 1.

Accordingly, when the polarized wave ratio of the small loop antenna 10 is different from the polarized wave ratio of the substrate 20, the polarized wave ratio of the whole of the antenna apparatus 1 in a case where the conductor 50 approaches the antenna apparatus 1 is changed from the polarized wave ratio of the whole of the antenna apparatus 1 in a case where there is no conductor 50, which approaches the apparatus 1. Thus, it is not preferable for the performance of the antenna apparatus 1 to vary the polarized wave ratio between a case of existence of the conductor 50 and a case of non-existence of the conductor 50.

For example, when the antenna apparatus 1 is used for an antenna of a mobile device in a system for a vehicle such as a keyless entry system and a smart system, it is preferable to set the polarized wave ratio to be 0 dB. This is because when only the small loop antenna 10 contributes to the polarized wave ratio of the whole of the apparatus 1 in a case where the conductor 50 approaches the apparatus 1, non-directional antenna performance of the synthesized polarized wave of the horizontal polarized wave and the vertical polarized wave is obtained.

In the above case, if the polarized wave ratio of the substrate 20 is not 0 dB, the polarized wave ratio of the whole of the apparatus 1 is changed between a case of existence of the conductor 50 and a case of non-existence of the conductor 50. Specifically, when the conductor 50 approaches the apparatus 1, the polarized wave ratio is 0 dB. However, when the conductor 50 does not approach the apparatus 1, the polarized wave ratio is not 0 dB. Thus, when the polarized wave ratio is not 0 dB, the non-directionality of the synthesized polarized wave is lost.

The reasons why it is preferable to have the non-directionality of the synthesized polarized wave are as follows. First, when the antenna apparatus 1 communicates with the other side such as an in-vehicle antenna by the electric wave, the other side may have a Null region. When the directionality of the other side as a communication other side provides the Null region, and the antenna apparatus 1 as a mobile device provides a Null region, the apparatus 1 may not communicate with the communication other side. Second, when the apparatus 1 is a mobile device, each user holds the apparatus 1 in a different manner. When the apparatus 1 is held by the user differently, in some cases, the Null region of the apparatus 1 does not cause communication problem. For example, the Null region exists at a place, which is opposite to the antenna direction. However, when the user changes to hold the mobile device in a different manner, the Null region of the apparatus 1 may cause communication problem. For example, the Null region exists at a place, which is disposed in the antenna direction.

Accordingly, in the present embodiment, when the polarized wave ratio of emission of the electric wave from the substrate 20 is equal to the polarized wave ratio of the small loop antenna 10, the non-directionality of the whole of the apparatus 1 is not changed substantially even when the conductor 50 approaches the apparatus 1. Specifically, in the present embodiment, the polarized wave ratio of the substrate 20 and the polarized wave ratio of the small loop antenna 10 are 0 dB, respectively, so that the non-directionality is secured.

When the polarized wave ratio of the substrate 20 is equal to the polarized wave ratio of the small loop antenna 10, the polarized wave ratio of the whole of the antenna apparatus 1 is not changed substantially even when the conductor 50 approaches the apparatus 1.

Further, the small loop antenna 10 is formed to set the polarized wave ratio of the small loop antenna 10 to be zero dB, and the substrate 20 is formed to have the horizontal length H of 40 millimeters and the vertical length V of 40 millimeters, the polarized wave ratio of the whole of the antenna apparatus 1 becomes zero dB. Further, in this case, even when the conductor 50 approaches the apparatus 1, the polarized wave ratio of 0 dB is maintained.

Alternatively, even when the polarized wave ratio of the substrate 20 and the polarized wave ratio of the small loop antenna 10 are 0 dB, the polarized wave ratio of the whole of the apparatus 1 is constant and zero dB without depending on existence or non-existence of the conductor 50 as long as the polarized wave ratio of the small loop antenna 10 is equal to the polarized wave ratio of the substrate 20.

The antenna apparatus 1 in the present embodiment includes the small loop antenna 10 and the ground substrate 20 as the equivalent dipole antenna 21. Each of the small loop antenna 10 and the ground substrate 20 has the same polarized wave components. Specifically, the ground substrate 20 functions as an antenna in a positive way. Thus, at least in a case where the conductor 50 does not approach the apparatus 1, the antenna apparatus 1 provides high gain.

Further, the dimensions and the shape of the substrate 20 are determined to have the polarized wave ratio equal to the small loop antenna 10. Thus, the polarized wave ratio of the whole of the apparatus 1 is constant even when the conductor 50 approaches the apparatus 1.

Accordingly, the apparatus 1 having the substantially constant polarized wave ratio without depending on existence or non-existence of the conductor 50 is manufactured, and the apparatus 1 provides high gain and low manufacturing cost.

In the present embodiment, the shape of the substrate 20 is a square shape, and the substrate 20 has a side in parallel to the horizontal polarized wave surface 41 and a side in parallel to the vertical polarized wave surface 42. The horizontal length H and the vertical length V are determined to equalize the polarized wave ratio of the substrate 20 to the polarized wave ratio equal to the small loop antenna 10 according to the relationship among the polarized wave ratio of the substrate 20 and the ratio of the horizontal length H and the vertical length V. Accordingly, the substrate 20 having the polarized waves in parallel to the horizontal polarized wave surface 41 and the vertical polarized wave surface 42 is surely and easily formed. Thus, the design of the whole of the antenna apparatus 1 is effectively performed.

(Modifications)

In the above embodiment, the substrate 20 has a square shape. Alternatively, the substrate 20 may have various shapes as long as the substrate 20 has two polarized wave surfaces, which correspond to the horizontal polarized wave surface 41 and the vertical polarized wave surface 42 of the small loop antenna 10, and the polarized wave ratio of the polarized wave surfaces of the substrate is equal to the polarized wave ratio between the horizontal polarized wave surface 41 and the vertical polarized wave surface 42 of the small loop antenna 10.

The shape and the dimensions of the small loop antenna 10 may be different from those in FIG. 1.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. An antenna apparatus comprising:

a ground substrate; and a loop antenna having a frame with two intersecting elements creating first and second polarized wave surfaces, wherein the substrate provides an antenna, which is excited and vibrated together with the loop antenna, wherein the antenna has a first polarized wave component in parallel to the first polarized wave surface and a second polarized wave component in parallel to the second polarized wave surface, wherein a polarized wave ratio between the first polarized wave component and the second polarized wave component in the substrate is substantially equal to a polarized wave ratio between the first polarized wave surface and the second polarized wave surface in the loop antenna, wherein the first polarized wave surface is perpendicular to the second polarized wave surface, wherein the substrate has a rectangular shape with four sides, wherein two sides of the substrate are in parallel to the first polarized wave surface, and other two sides of the substrate are in parallel to the second polarized wave surface, and wherein a length of each sides of the substrate is determined based on a predetermined relationship between the polarized wave ratio of the substrate and the length of each side of the substrate so that the polarized wave ratio of the substrate is substantially equal to the polarized wave ration of the loop antenna.

2. The antenna apparatus according to claim 1, wherein a first current component in parallel to the first polarized wave surface and a second current component in parallel to the second polarized wave surface flow on the substrate when the substrate provides the antenna, and wherein a ratio between the first current component and the second current component is substantially equal to the polarized wave ratio of the loop antenna.

3. The antenna apparatus according to claim 1, further comprising:

a circuit, wherein the antenna of the substrate is an equivalent dipole antenna, wherein the loop antenna has a loop shape with two ends, wherein one end of the loop antenna provides a power supply point, and the other end of the loop antenna provides a ground point, wherein the circuit energizes the loop antenna via the power supply point, and wherein the substrate is electrically coupled with the loop antenna via the ground point.

4. The antenna apparatus according to claim 3 wherein the loop shape is bent at a predetermined position by 90 degrees so that the loop antenna has two loop surfaces, wherein one loop surface corresponds to the first polarized wave surface, and the other loop surface corresponds to the second polarized wave surface, and wherein the substrate has a ground potential with respect to the circuit.

5. The antenna apparatus according to claim 1, wherein the loop antenna further includes a power supply point and a ground point, wherein the ground point is electrically coupled with the substrate, and wherein the substrate is electrically coupled with the loop antenna via the ground point so that the substrate provides the antenna.

6. The antenna apparatus according to claim 5, wherein the loop antenna has a loop shape with two ends, wherein one end of the loop antenna provides the power supply point, and the other end of the loop antenna provides the ground point, wherein the loop shape is bent at a predetermined position so that the loop antenna has two loop surfaces, and wherein one loop surface corresponds to the first polarized wave surface, and the other loop surface corresponds to the second polarized wave surface.

* * * * *